US005157731A

United States Patent [19]

Mitobe

[11] Patent Number: 5,157,731

[45] Date of Patent: Oct. 20, 1992

[54] DOME RADIATOR SPEAKER

[75] Inventor: Kunio Mitobe, Yamagata, Japan

[73] Assignee: Pioneer Electronic Corporation, Tokyo, Japan

[21] Appl. No.: 729,233

[22] Filed: Jul. 12, 1991

[30] Foreign Application Priority Data

Jan. 14, 1991 [JP] Japan ..... 3-15940

[51] Int. Cl.[5] ..... H04R 25/00

[52] U.S. Cl. ..... 381/202; 381/193; 381/194; 381/199

[58] Field of Search ..... 381/194, 195, 196, 197, 381/199, 201, 193, 202, 203

[56] References Cited

U.S. PATENT DOCUMENTS 2,392,143 1/1946 Graham ..... 381/194
3,867,586 2/1975 Maekawa et al. ..... 381/156
4,315,112 2/1982 Hofer ..... 381/194
4,554,414 11/1985 House ..... 381/194
4,565,905 1/1986 Nation ..... 381/194
4,752,963 6/1988 Yamazaki et al. ..... 381/194
5,099,949 3/1992 Mitobe ..... 381/193

*Primary Examiner*—Jin F. Ng
*Assistant Examiner*—Huyen D. Le
*Attorney, Agent, or Firm*—Nikaido, Marmelstein, Murray & Oram

[57] ABSTRACT

A dome radiator speaker has a yoke, an annular magnet mounted on the yoke, an annular plate mounted on the magnet, and a diaphragm sheet. The diaphragm sheet has a domed diaphragm, an annular voice coil housing having a U-shaped section surrounding the diaphragm, an annular damper around the voice coil housing, and an engaging recess formed on the underside of the diaphragm sheet at a peripheral portion of the damper. A voice coil is provided in the voice coil housing, and the voice coil housing is inserted in a gap between the pole and the annular plate. The recess is engaged with an annular projection formed on the plate. A frame is mounted on the plate for securing the damper on the plate.

4 Claims, 3 Drawing Sheets

DOME RADIATOR SPEAKER

BACKGROUND OF THE INVENTION

The present invention relates to a dome radiator speaker having a domed diaphragm, and more particularly to a mounting structure thereof.

A loudspeaker provided in an audio system is an electroacoustic device that converts electric signals (electrical energy) into acoustic signals (sound energy). Electrodynamic loudspeakers are widely used today.

One of the electrodynamic speakers is a dome radiator speaker, the working principle of which is the same as a cone loudspeaker, employing a voice coil and diaphragm arrangement. Whereas a voice coil of the cone loudspeaker is provided at the apex of a conical diaphragm, the voice coil of the dome loudspeaker is arranged around a dome shaped diaphragm to vibrate it. Since the diameters of the diaphragm and the coil are substantially the same in the dome loudspeaker, it is difficult to manufacture a loudspeaker with a large diaphragm. Hence the dome loudspeaker is used generally for reproducing sounds at middle and high frequencies.

Referring to FIG. 6, a conventional dome radiator speaker has a yoke 2 having a pole 1 and an annular magnet 3 and plate 4 which are mounted on the yoke 2. A domed diaphragm 5 is integrated with an outer peripheral damper 8 and an annular voice coil housing 6 between the diaphragm 5 and the damper 8. The voice coil housing 6 has a U-shaped section for housing a voice coil 9. The damper 8 is supported by an annular packing 7 so as to position the diaphragm 5 above the pole 1 and the voice coil housing 6 to surround the lower periphery of the diaphragm 5. A lead 10 is connected to the voice coil 9 for feeding audio current.

The fact that the diaphragm 5 and the voice coil housing 6 are integrally formed enables the vibration of the voice coil 9 to be transferred to the diaphragm 5 without a loss. Since the housing 6 is formed between the diaphragm 5 and the damper 8, a warp due to the shape of the housing 6 does not occur. In addition, the integral structure of the diaphragm 5 and the housing 6 and the damper 8 improves the assembling efficiency of the loudspeaker.

However, since the voice coil 9 is secured to the voice coil housing 6 through a rubber adhesive, the coil 9 may be fused by the heat of the adhesive to cause cutoff of the coil. Moreover, the coil 9 may not be accurately positioned.

SUMMARY OF THE INVENTION

The object of the present invention is to provide a reliable dome radiator loudspeaker which can be easily assembled.

According to the present invention there is provided a dome radiator speaker comprising a yoke having a pole at a central portion thereof and an annular positioning shoulder around a lower portion of the pole, an annular magnet mounted on the yoke around the positioning shoulder, an annular plate mounted on the magnet and surrounding the pole, a diaphragm sheet having a domed diaphragm, an annular voice coil housing having a U-shaped section surrounding the diaphragm, and an annular damper around the voice coil housing, which are integrated in one-piece, and an engaging recess formed at a peripheral portion of the damper.

A voice coil is provided in the voice coil housing, and the voice coil housing is inserted in a gap between the pole and the annular plate.

A frame is securely mounted on the plate, and the engaging recess is engaged with an annular projection formed on the plate.

The other objects and features of this invention will become understood from the following description with reference to the accompanying drawing.

DETAILED DESCRIPTION OF THE PREFERRED EMBODIMENTS

Figure 1:
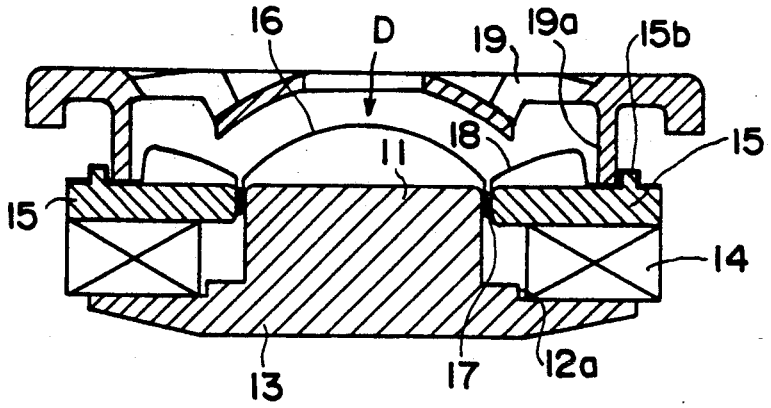
FIG. 1 is a sectional view of a dome radiator speaker according to the present invention.

Referring to FIG. 1, a dome loudspeaker according to the present invention has a yoke 13 having a pole 11 at the center thereof and an annular positioning shoulder **12*a* on the lower periphery of the pole 11, annular magnet 14 and an annular metal plate 15 which are mounted on the yoke 13. A diaphragm sheet D has a domed diaphragm 16, an annular voice coil housing 17 around the diaphragm and an annular damper 18 around the housing which are integrally formed in one-piece. The diaphragm sheet is arranged to cover the yoke 13 and the plate 15, and held in place by a frame 19. The plate 15 has an annular projection 15*b*** along the outer edge thereof.

Figure 2:
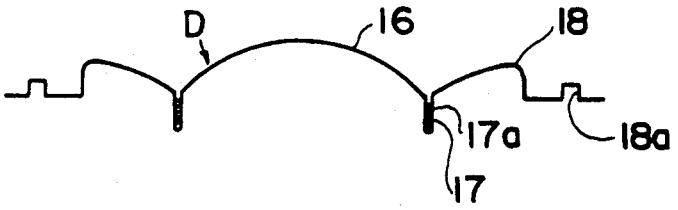
FIG. 2 is a schematic diagram showing an integrally formed diaphragm, voice coil housing and a damper provided in the loudspeaker of FIG. 1.

As shown in FIG. 2, the voice coil housing 17 having a U-shaped section for housing an air-core voice coil **17*a* is formed on the lower outer periphery of the diaphragm 16. On the periphery of the damper 18 an annular rib 18*a* is provided to form an engaging recess on the underside thereof. The rib 18*a* fits on the projection 15*b* of the plate 15. The frame 19 has an annular projection 19*a* which abuts on the plate 15 and the inside wall of the rib 18*a*, so that the frame 19 is positioned. Thus, when the loudspeaker is assembled, the diaphragm 16 and the housing 17 are securely supported on the plate 15 through the damper 18**.

The diaphragm 16 is made of such materials as polyimide, polyphnylene sulfide and alamide films which all have high dimensional stability even at the temperature of 100° C. and good acoustic chateristics.

Figure 3:
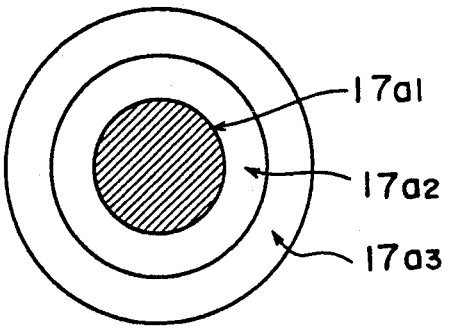
FIG. 3 is a sectional view of a voice coil provided in the loudspeaker of FIG. 1.

Referring to FIG. 3, the wire of voice coil **17*a* comprises a conductive wire $17a_1$, insulation layer $17a_2$ over the wire $17a_1$, and an outermost coating layer $17a_3$. The coil 17*a* is set in the housing 17 to which ultraviolet ray setting hardener is injected thereafter. When the ultraviolet ray is radiated the hardener is set, thereby fixing the coil 17*a* in the housing 17**. The ultraviolet ray setting hardener may be a two-part hardener or an anaerobic hardener, so that the portion of the hardener which is not irradiated with the ultraviolet ray also hardens.

In order to assemble the dome radiator speaker, first the magnet 14 is mounted on the yoke 13. The magnet 14 is so positioned that the inner periphery thereof abuts against the outer periphery of the shoulder 12*a*, thereby exactly positioning the magnet 14. Secondly, the plate 15 is mounted and positioned on the magnet 14, using a known gap gauge.

Next, the diaphragm sheet D is placed on the plate 15. The sheet D is so designed that when the rib 18*a* of the damper 18 engages the projection 15*b* of the plate 15, the voice coil housing 17 fits in a gap between the outer periphery of the pole 11 of the yoke 13 and the inner periphery of the plate 15. Thus the domed diaphragm 16 is disposed above the pole 11.

Thereafter, the voice coil 17*a* is inserted in the housing 17. The ultraviolet ray setting hardener is injected and irradiated with the ultraviolet ray. As a result, the voice coil 17*a* is adhered inside the housing 17. The frame 19 is mounted on the plate 15 interposing the sheet D. The frame 19 is designed such that the projection 19*a* thereof snugly fits in the inside of the projection 15*b* through the damper so that the frame 19 is accurately positioned.

Each part of the loudspeaker of the present invention are provided with a projection and a recess for engaging with one another. Hence the loudspeaker is easily and accurately assembled. The voice coil 17*a* is also exactly aligned and secured with the ultraviolet ray setting hardener.

Figure 4:
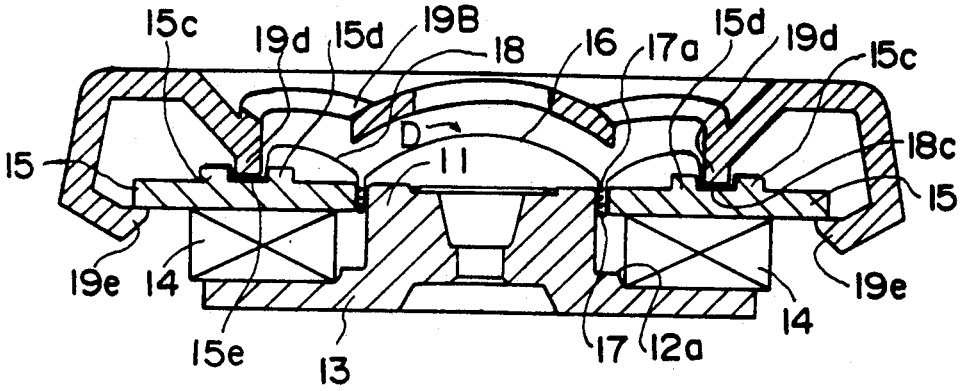
FIG. 4 is a sectional view of a second embodiment of the loudspeaker of the present invention.

FIG. 4 shows the second embodiment of the dome radiator speaker according to the present invention. The same references as those in FIG. 1 designate the same parts in FIG. 4 so that the descriptions thereof are omitted. In the embodiment, the plate 15 has a pair of concentric projections 15*c* and 15*d* on the upper surface thereof, forming an annular groove 15*e* there-between. The damper 18 accordingly has an annular downwardly extending projection 18*c* for engaging the groove 15*e*. A frame 19B has an annular projection 19*d* which fits in the groove 15*e* through the damper 18. The periphery of the frame 19B is extended to form inwardly bent portion which has a plurality of pawls 19*e* along the edge.

For assembling the loudspeaker, the magnet 14 and the plate 15 are mounted on the yoke 13 in the same manner as in the first embodiment. The diaphragm sheet D is disposed on the plate 15 so as to engage the projection 18*c* with the groove 15*e* between the projections 15*c* and 15*d*. Accordingly, the housing 17 is inserted in a gap between the pole 11 and the plate 15. The frame 19B is mounted on the plate 15 so that the projection 19*d* is engaged with the groove 15*e* while interposing the projection 18*c* of the sheet D. The pawls 19*e* of the frame 19B engage the bottom peripheral edge of the plate 15. Thus the frame 19B and the diaphragm 16 can be easily and accurately positioned. The other constructions are the same as in the first embodiment.

Figure 5:
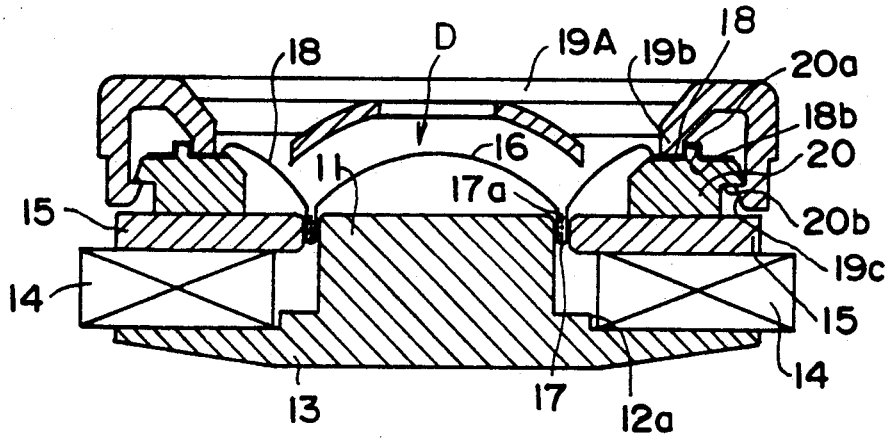
FIG. 5 is a sectional view of a third embodiment of the loudspeaker of the present invention.
Figure 6:
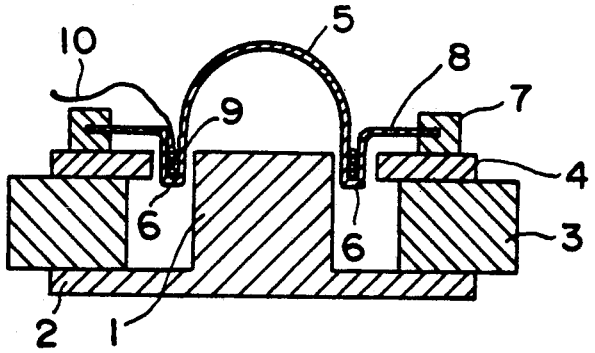
FIG. 6 is a sectional view of a conventional dome radiator speaker.

Referring to FIG. 5, the loudspeaker of the third embodiment is provided with a plastic ring 20 which is securely mounted on top of the plate 15. The ring 20 has an upwardly extending annular projection 20*a* which engages a recess 18*b* of the damper 18. The lower outer peripheral portion of the ring 20 is cut away, thereby forming a shoulder 20*b* along the upper periphery of the ring 20. A frame 19A has an annular projection 19*b*, and pawls 19*c* on a lower inner periphery to be engaged with the shoulder 20*a* of the ring 20.

The dome loudspeaker is assembled as follows. The magnet 14 is mounted on the yoke 13 and held in the appropriate position by the shoulder 12*a*. The plate 15 is further mounted on the magnet 14 and the ring 20 is securely mounted on the top of the plate. The diaphragm sheet D comprising the diaphragm 16, voice coil housing 17 and the damper 18 is disposed to cover the ring 20 and the pole 11. The position of the ring 20 is determined so that the recess 18*b* of the damper 18 engages the projection 20*a* and the voice coil housing 17 fits in a gap between the pole 11 and the plate 15. Thereafter, the projection 19*b* of the frame 19A is inserted inside the projection 20*a* of the ring 20 to mount the frame 19A on the ring 20. The pawls 19*c* are engaged with the shoulder 20*b*, thereby clamping the frame 19A to the ring 20. Thus the diaphragm 16 is easily and accurately positioned.

In the present embodiment, the assembling efficiency is improved by providing the plastic ring 20 so that, it is possible to automate the assemblage, and furthermore, to increase the accuracy thereof.

In accordance with the present invention, there is provided a dome radiator speaker where the positioning of each part is easily and accurately performed. Moreover, the aligning and the fixing of the voice coil also becomes simple and accurate. Hence the reliability of the loudspeaker and the assemblage thereof are improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A dome radiator speaker comprising:

a yoke having a pole at a central portion thereof and an annular positioning shoulder at an outer periphery of a lower portion of the pole;

an annular magnet mounted on the yoke around the positioning shoulder;

an annular plate mounted on the magnet and surrounding the pole;

a diaphragm sheet having a domed diaphragm, an annular voice coil housing having a U-shaped section surrounding the diaphragm, and an annular damper around the voice coil housing, which are integrated in one-piece, and an engaging recess formed at a peripheral portion of the damper to form an annular groove;

a voice coil provided in the voice coil having;

said voice coil housing being inserted in a gap between the pole and the annular plate;

a frame having an annular projection and securely mounted on the plate; and a peripheral portion of the diaphragm sheet being interposed between the annular projection and the annular plate;

the annular groove of the engaging recess being engaged with an annular member formed on one of the annular plate and the frame so as to position the diaphragm sheet.

2. The dome radiator speaker according to claim 1 wherein the annular member is an annular projection formed on the plate.

3. The dome radiator speaker according to claim 1 wherein the annular member is an annular projection formed on the frame.

4. The dome radiator speaker according to claim 1 further comprising a ring provided on the plate for attaching the diaphragm sheet and the frame.

* * * * *